United States Patent [19]

Muench

[11] Patent Number: 4,977,950

[45] Date of Patent: Dec. 18, 1990

[54] EJECTION NOZZLE FOR IMPOSING HIGH ANGULAR MOMENTUM ON MOLTEN METAL STREAM FOR PRODUCING PARTICLE SPRAY

[75] Inventor: George J. Muench, Hamden, Conn.

[73] Assignee: Olin Corporation, New Haven, Conn.

[21] Appl. No.: 322,435

[22] Filed: Mar. 13, 1989

[51] Int. Cl.[5] ..... B22D 23/00

[52] U.S. Cl. ..... 164/429; 164/46; 239/489; 239/590; 239/466

[58] Field of Search ..... 164/46, 429; 239/489, 239/590, 466, 214, 499, 380; 427/422, 423; 118/302

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. | 117/38 |
| 2,972,185 | 2/1961 | Brennan | 29/420.5 |
| 3,608,615 | 9/1971 | Conlon | 164/87 |
| 3,727,672 | 4/1973 | Grenfell . | |
| 3,742,585 | 7/1973 | Wentzell | 29/423 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 4,512,384 | 4/1985 | Sendzimir | 164/46 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | | |
|---|---|---|---|
| 0225732 | 6/1987 | European Pat. Off. . | |
| 0225080 | 10/1987 | European Pat. Off. . | |
| 726734 | 9/1942 | Fed. Rep. of Germany | 239/489 |
| 969426 | 5/1958 | Fed. Rep. of Germany | 239/390 |
| 671859 | 7/1979 | U.S.S.R. | 239/466 |
| 957978 | 9/1982 | U.S.S.R. | 239/466 |
| 1141205 | 2/1985 | U.S.S.R. | 239/466 |
| 1379261 | 2/1975 | United Kingdom . | |
| 1472939 | 5/1977 | United Kingdom . | |
| 2007129 | 5/1979 | United Kingdom . | |
| 1548616 | 7/1979 | United Kingdom . | |
| 1599392 | 9/1981 | United Kingdom . | |
| 2172827 | 10/1986 | United Kingdom . | |
| 2172900 | 10/1986 | United Kingdom . | |

OTHER PUBLICATIONS

R. W. Evans et al, "The Osprey Preform Process", 1985, pp. 13–20, *Powder Metallurgy*, vol. 28, No. 1.

A. G. Leatham et al, "The Osprey Process for the Production of Spray-Deposited Roll, Disc, Tube and Billet Preforms", 1985, pp. 157–173, *Modern Developments in Powder Metallurgy*, vols. 15–17.

*Primary Examiner*—Kuang Y. Lin

*Attorney, Agent, or Firm*—H. Samuel Kieser

[57] ABSTRACT

A molten metal spray-depositing apparatus employs an ejection nozzle for receiving a molten metal stream and having a configuration for confining and imparting mechanically an angular momentum thereto which produces stream break-up into a metal particle spray when the stream becomes unconfined upon exiting the nozzle. There are stationary and rotating versions of the ejection nozzle. The stationary ejection nozzle has a flow channel with internal angular elements, such as spiral grooves, which engage the moving molten metal stream to impart angular momentum thereto as it passes through the channel. The rotating ejection nozzle may have internal elements within the flow channel, such as notches or serrations, which engage the moving molten stream and cause it to rotate with the nozzle as it passes through the channel. The two nozzles can also be combined to impart the angular momentum and accomplish melt stream break-up.

23 Claims, 2 Drawing Sheets

EJECTION NOZZLE FOR IMPOSING HIGH ANGULAR MOMENTUM ON MOLTEN METAL STREAM FOR PRODUCING PARTICLE SPRAY

The present invention generally relates to metal particle spray-deposited production of a product and, more particularly, is concerned with an ejection nozzle for imposing a high angular momentum on a molten metal stream to cause break-up of the stream into a spray of metal particles.

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R.W. Evans et al, *Powder Metallurgy,* Vol. 28, No. 1 (1985), pages 13–20 and "The Osprey Process for the Production of Spray-Deposited Roll, Disc, Tube and Billet Preforms" by A.G. Leatham et al, *Modern Developments in Powder Metallury,* Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a preforming mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in U.S. Pat. No. 3,775,156 and European Pat. Appln. No. 225,080. For producing these products, a substrate or collector, such as a flat substrate, an endless belt or a rotatable mandrel, is moved continuously through the spray to receive a deposit of uniform thickness across its width.

In the Osprey process, the gas-atomizing jets break up the molten metal stream and produce the spray of metal particles by impact from high pressure gas flows. It is thought that the ultrasonic shock wave of these gas flows is responsible for disrupting the melt stream and causing droplet or particle formation. A problem with this technique is the amount of gas necessary to cause droplet formation. This great quantity of gas requires expensive gas handling equipment. Furthermore, gas flows away from the melt stream carry away small droplets of metal. These small particles in the exhaust gas reduce process yield and remove what are potentially the most useful component.

Some techniques of centrifugal atomization have been used in the prior art to produce particles or droplets of molten metal. These techniques include rotating consumable electrodes and rotating molten metal receiving cups. It has been found that rotation speeds of several thousand RPM are sufficient to create the desired particles. However, there are drawbacks associated with each of these prior art techniques. Feedstock must be in the form of solid cylinders to be used as consumable electrodes. In principle, a melt stream can be used to fill a rotating cup. However, splashing of the melt stream during pouring into the rotating cup can be a significant problem. Further, low throughput is a drawback with both techniques.

Therefore, a need exists for an alternative approach for producing break-up of the molten metal stream into a particle spray which avoids the problems associated with gas atomization and the drawbacks of prior art centrifugal atomization techniques.

The present invention provides an ejection nozzle designed to satisfy the aforementioned needs. The ejection nozzle of the present invention mechanically imposes a high angular momentum on a molten metal stream to cause break-up of the stream into a spray of metal particles. Higher throughput can be expected from using the ejection nozzle of the present invention than from using the prior art centrifugal atomization techniques.

In accordance with the present invention, there are two basic versions of the ejection nozzle. In one version the nozzle is stationary, whereas in the other version the nozzle rotates. The ejection nozzles have different configurations and modes of operation.

More particularly, the stationary ejection nozzle has a flow orifice with internal angular elements, such as spiral grooves, which engage the moving molten metal stream to impart angular momentum to the melt stream and produce stream break-up. The rotating ejection nozzle has a flow channel which engages the moving molten stream and causes it to rotate with the nozzle as it passes there through, rendering the stream unstable and subject to break-up when it leaves the rotating nozzle. The engagement between the flow channel of the nozzle and the melt stream can be augmented by internal elements, such as notches or serrations. The internal elements at the orifice of the nozzle may be chosen as to provide an appropriate shape to the exiting mold stream, i.e.; small streamlets. Furthermore, the rotating ejection nozzle can be driven by any suitable mechanism, including either mechanical or pneumatic means.

Also, in accordance with the present invention, the two nozzles can be combined to impart angular momentum and accomplish melt stream break-up. For example, a stationary grooved nozzle can be used to feed a rotating nozzle.

Thus, the concept underlying the present invention, being applicable to both the stationary and rotating nozzles, is to impart high angular momentum to the melt stream while confined within the nozzle so that the melt stream, upon exiting the nozzle orifice, will decompose into a spray of particles as the metal moves radially due to rotational inertia. The size of the particles will be a function of the magnitude of the angular momentum and the surface tension of the metal.

These and other features and advantages of the present invention will become apparent to those skilled in the art upon a reading of the following detailed description when taken in conjunction with the drawings wherein there is shown and described an illustrative embodiment of the invention.

In the course of the following detailed description, reference will be made to the attached drawings in which.

Figure 1:
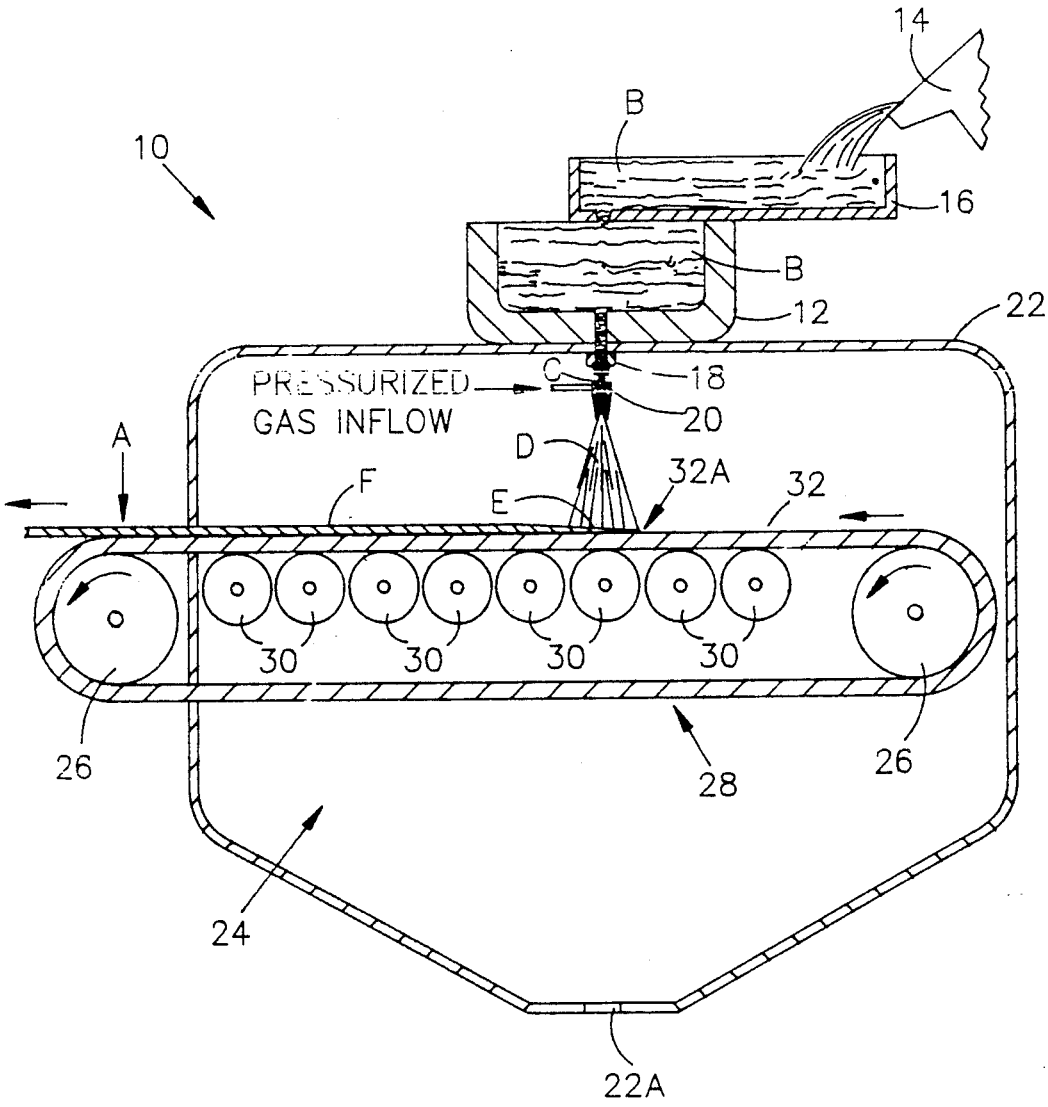
PRIOR ART FIG-1
FIG. 1 is a schematic view, partly in section, of a prior art spray-deposition apparatus for producing a product on a moving substrate, such as in thin gauge strip form.

Referring now to the drawings, and particularly to FIG. 1, there is schematically illustrated a prior art spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12.

Also, a gas-atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles. The particles broadcast downwardly from the atomizer 20 in the form of a divergent conical pattern. If desired, more than one atomizer 20 can be used. Also, the atomizer(s) can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizer 20. The substrate system 24 includes drive means in the form of a pair of spaced rolls 26, an endless substrate 28 in the form of a flexible belt entrained about and extending between the spaced rolls 26, and support means in the form of a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product A.

The atomizing gas flowing from the atomizer 20 is much cooler than the solidus temperature of the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles overspray the substrate 28, solidify and fall to the bottom of the spray chamber 22 where they along with the atomizing gas flow from the chamber via an exhaust port 22A.

One problem with using the prior art technique of gas atomization to convert the molten metal stream C into the metal particle spray D is the large amount of gas necessary to cause droplet or particle formation. This great quantity of gas requires expensive gas handling equipment. Furthermore, gas flows away from the melt stream carry away small droplets of metal. These small particles in the exhaust gas reduce process yield and remove what are potentially the most useful component.

Figure 2:
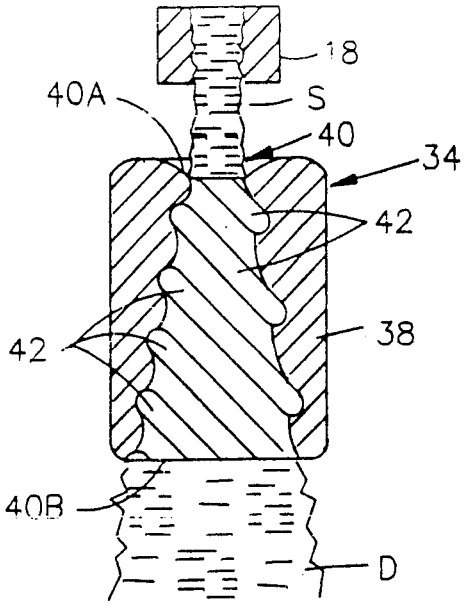
FIG. 2 is a fragmentary schematic view, partly in section, of one modified form of the spray-deposition apparatus employing a first version of an angular momentum generating ejection nozzle in accordance with the present invention.
Figure 3:
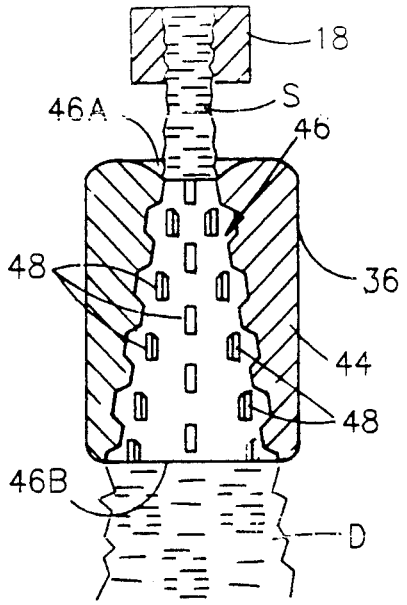
FIG. 3 is a fragmentary schematic view, partly in section, of another modified form of the spray-deposition apparatus employing a second version of an angular momentum generating ejection nozzle in accordance with the present invention.

The solution of the present invention is to employ an angular momentum generating device instead of the spray atomizer 20 for breaking up the molten metal stream C. Referring now to FIGS. 2 and 3, in accordance with the present invention there are schematically illustrated two different versions of the device for mechanically imposing a high angular momentum on the molten metal stream C to cause break-up of the stream into the spray D of metal particles. In the one version of FIG. 2, the device is a stationary injection nozzle 34. In the other version of FIG. 3, the device is a rotating injection nozzle 36. The ejection nozzles 34, 36 have different configurations and modes of operation.

More particularly, as can be seen in FIG. 2, the stationary ejection nozzle 34 has a body 38 with a flow channel 40 extending therethrough. Preferably, the channel 40 gradually expands in diameter from a top entry end 40A to a bottom exit end 40B thereof. The body 38 has a plurality of internal angular elements 42, such as spiral grooves, which communicate with the channel 40. The elements 42 engage the moving molten metal stream C and mechanically impart angular momentum thereto as it passes through the orifice 40. The angular momentum so imparted renders the rotating stream C unstable and produces its break-up into the molten metal spray D upon exiting the orifice 40.

As shown in FIG. 3, the rotating ejection nozzle 36 has a body 44 with a flow channel 46 extending therethrough. As in the case of hte stationary ejection nozzle 34, the channel 46 of the rotating ejection nozzle 36 preferably gradually expands in diameter from a top entry end 46A to a bottom exit end 46B thereof. The body 44 has a plurality of internal elements 48, such as notches or serrations, which communicate with the channel 46. The internal elements 48 engage the moving molten stream and mechanically impart angular momentum to it by causing it to rotate with the nozzle 36 as it passes through the channel 46. The angular momentum so imparted renders the stream unstable and causes it to break-up into the molten metal spray D when it leaves the rotating nozzle 36.

Figure 4:
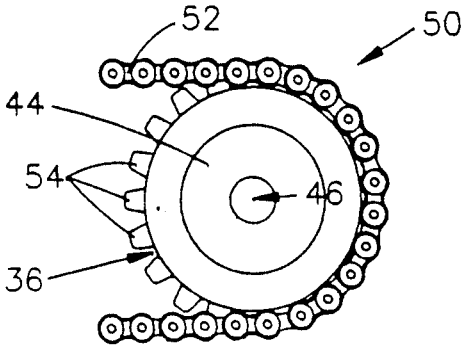
FIG. 4 is a schematic view, partly in section, of the second nozzle version having a mechanical mechanism coupled thereto for driving the rotation of the nozzle.
Figure 5:
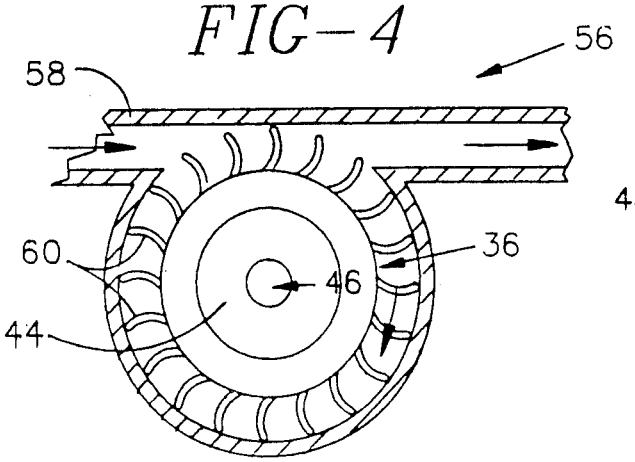
FIG. 5 is a schematic view, partly in section, of the second nozzle version having a pneumatic mechanism coupled thereto for driving the rotation of the nozzle.

Furthermore, the rotating ejection nozzle 36 can be driven by any suitable mechanism. In FIG. 4, a mechanical drive mechanism 50 is illustrated. The mechanical drive mechanism 50 includes a drive chain 52 coupled between a drive sprocket (not shown) and a driven sprocket 54 attached on the exterior of the nozzle 36 for driving the rotation of the nozzle 36. In FIG. 5, a pneumatic drive mechanism 56 is shown. The pneumatic drive mechanism 56 includes an air flow conduit 58 providing a pressurized flow of air for rotatably driving a plurality of impeller blades 60 attached on the exterior of the nozzle 36 and thereby driving rotation of the nozzle.

Figure 6:
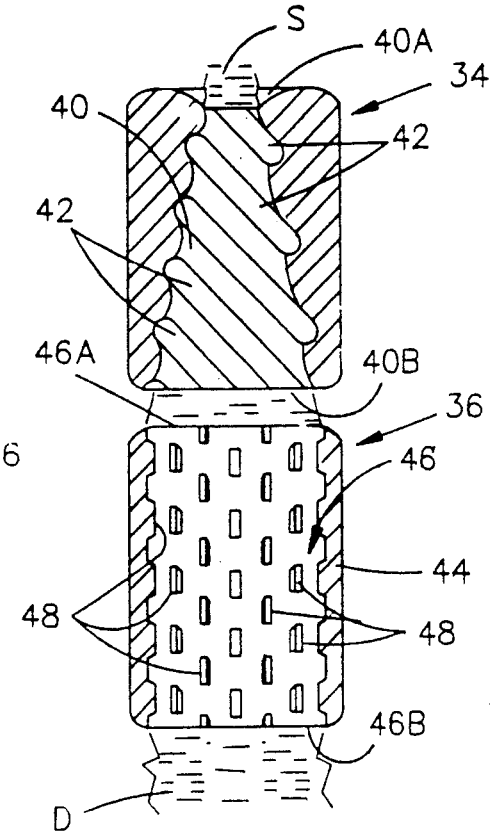
FIG. 6 is a fragmentary schematic view, partly in section, of still another modified form of the spray-deposition apparatus employing a combination of the first and second nozzle versions.

Turning to FIG. 6, also in accordance with the present invention, the two ejection nozzle 34, 36 can be combined to impart angular momentum and accomplish melt stream break-up. For example, the two nozzles 34, 36 can be disposed in a tandem relation with one above the other. In this case, the top entry 46A of the flow channel 46 of the rotating nozzle 36 would have a diameter substantially equal to the diameter of the bottom exit end 40B of the flow channel 40 of the stationary nozzle 34. The bottom exit end 46B of the flow channel 46 of the rotating nozzle 36 may have a diameter substantially the same as, or larger than, the diameter of the top entry end 46A.

Thus, the concept underlying the present invention, being applicable to both the stationary and rotating nozzles 34, 36, is to impart high angular momentum to the melt stream while confined in passing through the flow channel in the nozzle so that the melt stream, when later unconfined upon exiting the nozzle orifice, will decompose into a spray of particles as the metal moves radially due to rotational inertia. The size of the particles will be a function of the magnitude of the angular momentum and the surface tension of the metal.

In the case of the rotating nozzle 36, as the melt stream flows through the nozzle, the metal will pick up an angular velocity equal to that of the nozzle. Thus, when the metal stream exits the rotating nozzle, it will be unstable and break up. The velocity vector of the particles will be a function of the linear momentum and angular momentum of the stream C. A gas stream may be used to adjust the velocity vector of the particles and/or to remove heat from the particles. The imparting of angular momentum to the stream and subsequent breakup thereof is assisted by the configuration of the nozzle orifice, i.e., the gradually expanding orifice and the notches or serrations.

In the case of the stationary nozzle 34, as the melt stream flows through the nozzle, the internal grooves will impart angular momentum to the melt stream much like rifling spins a bullet. The rate of spin is the product of the pitch of the grooves and the velocity of the melt stream. For pitches on the order of 1 rev/cm and melt stream velocities on the order of 1 m/sec, the stream rotation will be 6000 rpm. The stationary nozzle 34 provides a mechanically simpler scheme than the rotating nozzle 36 to obtain a high angular momentum stream. However, a disadvantage of the stationary nozzle 34 is that it is impossible to control stream velocity and rotation independently without changing nozzles.

As mentioned above, the combination of the two rotation techniques is possible. For example, the stationary nozzle 34 could be used to feed the rotating nozzle 36. This combination would permit more control over stream conditions, but at the cost of additional mechanical complexity.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. In a non-gaseous molten metal spray-depositing apparatus, the combination comprising:

(a) means for producing a stream of molten metal;

(b) means defining at least one flow channel for receiving the molten metal stream and having a configuration for confining the stream within said flow channel and mechanically imparting an angular momentum thereto as the stream passes through said channel which renders the stream unstable and produces its break-up into a molten metal spray without the use of gas when the stream becomes unconfined upon existing said orifice;

(c) means movable along a path and having an area thereon disposed below said molten metal spray for receiving a deposit of said molten metal spray to form a product on said movable means; and (d) means for removing said deposited product from said movable means.

2. The apparatus as recited in claim 1, wherein said flow channel defining means is a stationary ejection nozzle having a body with said flow channel extending therethrough.

3. The apparatus as recited in claim 2, further comprising:

a plurality of internal elements defined on said body which are exposed to the stream within said flow channel for engaging the stream and mechanically imparting the angular momentum thereto as it passes through said channel.

4. The apparatus as recited in claim 3, wherein said angular momentum imparting elements are a plurality of angular grooves defined in said body in communication with said channel.

5. The apparatus as recited in claim 1, wherein said flow channel defining means is a rotating ejection nozzle having a body with said flow channel extending therethrough.

6. The apparatus as recited in claim 5, further comprising:

a plurality of internal elements defined on said body which are exposed to the stream within said flow channel for engaging the stream and mechanically imparting the angular momentum thereto as it passes through said channel.

7. The apparatus as recited in claim 6, wherein said angular momentum imparting elements are a plurality of notches defined in said body in communication with said channel for engaging the stream and causing it to rotate with said nozzle as it passes through said channel and thereby imparting angular momentum thereto which renders it unstable and produces its break-up into a molten metal spray upon exiting said orifice.

8. The apparatus as recited in claim 5, further comprising:

means coupled to said rotating ejection nozzle for rotatably driving the same.

9. The apparatus as recited in claim 8, wherein said driving means is a mechanical drive mechanism.

10. The apparatus as recited in claim 8, wherein said driving means is a pneumatic drive mechanism.

11. The apparatus as recited in claim 1, wherein said channel gradually expands in diameter from an entry end to an exit end thereof.

12. In a molten metal spray-depositing apparatus, the combination comprising:

(a) means for producing a stream of molten metal; and (b) means defining at least a pair of upper and lower flow channels being disposed in tandem relation one above the other for receiving the molten metal stream and having configurations for confining the stream within said flow channels and mechanically imparting an angular momentum thereto as the stream passes through said channels which renders the stream unstable and produces its break-up into a molten metal spray when the stream becomes unconfined upon exiting said lower one of said orifices.

13. The apparats as recited in claim 12, wherein said flow channels defining means is a pair of upper and lower ejection nozzles, each having a body with one of said flow channels therethrough.

14. The apparatus as recited in claim 13, wherein said upper ejection nozzle is a stationary nozzle.

15. The apparatus as recited in claim 13, further comprising:

a plurality of internal elements defined on said body of said upper ejection nozzle which are exposed to the stream within said flow orifice for engaging the stream and mechanically imparting the angular momentum thereto as it passes through said orifice.

16. The apparatus as recited in claim 15, wherein said angular momentum imparting elements in said upper ejection nozzle are a plurality of angular grooves defined in said body in communication with said orifice.

17. The apparatus as recited in claim 13, wherein said lower ejection nozzle is a rotating nozzle.

18. The apparatus as recited in claim 17, further comprising:

a plurality of internal elements defined on said body of said lower ejection nozzle which are exposed to the stream within said flow channel for engaging the stream and mechanically imparting the angular momentum thereto as it passes through said orifice.

19. The apparatus as recited in claim 18, wherein said angular momentum imparting elements in said lower ejection nozzle are a plurality of notches defined in said body in communication with said channel for engaging the stream and causing it to rotate with said nozzle as it passes through said orifice and thereby imparting angular momentum thereto which renders it unstable and produces its break-up into a molten metal spray upon exiting said lower orifice.

20. The apparatus as recited in claim 17, further comprising:

means coupled to said rotating ejection nozzle for rotatably driving the same.

21. The apparatus as recited in claim 20, wherein said driving means is a mechanical drive mechanism.

22. The apparatus as recited in claim 20, wherein said driving means is a pneumatic drive mechanism.

23. The apparatus as recited in claim 12, wherein said upper flow channel gradually expands in diameter from an entry end to an exit end thereof.

* * * * *